US010845046B2

(12) United States Patent
Kohen

(10) Patent No.: US 10,845,046 B2
(45) Date of Patent: Nov. 24, 2020

(54) CONNECTING LIGHTING TO POLES WITHOUT TOOLS

(71) Applicant: Ran Roland Kohen, Aventura, FL (US)

(72) Inventor: Ran Roland Kohen, Aventura, FL (US)

( * ) Notice: Subject to any disclaimer, the term of this patent is extended or adjusted under 35 U.S.C. 154(b) by 0 days.

(21) Appl. No.: 16/609,875

(22) PCT Filed: May 1, 2018

(86) PCT No.: PCT/US2018/030372
§ 371 (c)(1),
(2) Date: Oct. 31, 2019

(87) PCT Pub. No.: WO2018/204313
PCT Pub. Date: Nov. 8, 2018

(65) Prior Publication Data

US 2020/0056773 A1 Feb. 20, 2020

Related U.S. Application Data

(60) Provisional application No. 62/492,596, filed on May 1, 2017.

(51) Int. Cl.
*F21V 23/06* (2006.01)
*F21S 8/08* (2006.01)
(Continued)

(52) U.S. Cl.
CPC ..... *F21V 23/06* (2013.01); *F21S 8/086* (2013.01); *F21V 21/116* (2013.01);
(Continued)

(58) Field of Classification Search
CPC ..... F21S 8/086; F21V 23/06; F21V 23/0442; F21V 21/116; F21W 2131/00;
(Continued)

(56) References Cited

U.S. PATENT DOCUMENTS 484,911 A 10/1892 Green
1,595,972 A 8/1926 DeReamer
(Continued)

FOREIGN PATENT DOCUMENTS

CN 1728475 A 2/2006
CN 01 8 23877.7 11/2007
(Continued)

OTHER PUBLICATIONS

International Preliminary Report on Patentability dated Nov. 5, 2019 for International Application No. PCT/US2018/030372 filed May 1, 2018, 6 pages.
(Continued)

*Primary Examiner* — Harshad C Patel
(74) *Attorney, Agent, or Firm* — Paul D. Bianco; Gary S. Winer; Fleit Intellectual Property Law

(57) ABSTRACT

A street light has a pole of at least 6 feet in length, and has an electrical socket attached to an end of the pole. The socket includes a body having an interior, and a cover positioned on the body to cover the interior of the body. The cover has a ring-shaped openings providing passage into the interior of the body. Resiliently mounted electrical contactors are each positioned in the interior of the body and adjacent to one of the ring-shaped openings in the cover. A central bore extends through the body, and a ledge is positioned at the end of the bore to extend radially outward. The socket is connectable to a mating plug to mechanically and electrically connect a street light or other device to the pole. The street light can include sensors that are connectable using a similar socket and plug.

19 Claims, 6 Drawing Sheets

(51) Int. Cl.

| | |
|---|---|
| ***F21V 21/116*** | (2006.01) |
| ***F21V 23/04*** | (2006.01) |
| ***H01R 13/627*** | (2006.01) |
| ***H01R 24/38*** | (2011.01) |
| ***H01R 33/97*** | (2006.01) |
| ***H01R 39/64*** | (2006.01) |
| *F21W 131/103* | (2006.01) |
| *H01R 107/00* | (2006.01) |

(52) U.S. Cl.
CPC ..... *F21V 23/0442* (2013.01); *H01R 13/6276* (2013.01); *H01R 24/38* (2013.01); *H01R 33/97* (2013.01); *H01R 39/64* (2013.01); *F21W 2131/103* (2013.01); *H01R 2107/00* (2013.01); *H01R 2201/08* (2013.01)

(58) Field of Classification Search
CPC .... H01R 13/6276; H01R 24/38; H01R 33/97; H01R 39/64; H01R 2107/00; H01R 2201/08
USPC ..... 439/21; 362/431, 410
See application file for complete search history.

(56) References Cited

U.S. PATENT DOCUMENTS 1,897,954 A 2/1933 D'Olier
2,077,587 A 4/1937 Rowe
2,308,016 A 1/1943 Mihalyi
2,313,481 A 3/1943 Rendano
2,494,428 A 1/1950 Buck
2,673,966 A 3/1954 Larkin
2,726,372 A 12/1955 Appleton
2,728,895 A 12/1955 Quackenbush
2,863,037 A 12/1958 Johnstone
3,056,035 A * 9/1962 Bernheim ..... H01H 37/04 250/239
3,118,713 A 1/1964 Ellis
3,159,444 A 12/1964 Stine
3,193,636 A 7/1965 Daniels
3,386,071 A 5/1968 Allen
3,398,260 A 8/1968 Martens
3,521,216 A 7/1970 Tolegian
3,585,564 A 6/1971 Skjervoll
3,648,002 A 3/1972 Du Rocher
3,651,443 A 3/1972 Quilez
3,668,603 A 6/1972 Burgess et al.
3,798,584 A 3/1974 Person
3,808,577 A 4/1974 Mathauser
3,813,478 A 5/1974 Ervin
3,855,564 A 12/1974 Dumas
3,871,732 A 3/1975 Appleton
4,059,327 A 11/1977 Vann
4,079,244 A 3/1978 Bortoluzzi
4,083,619 A 4/1978 McCormick et al.
4,107,770 A 8/1978 Weber
4,133,594 A 1/1979 Laverick et al.
4,335,927 A 6/1982 Allen et al.
4,448,388 A 5/1984 Dennis
4,462,653 A 7/1984 Rederbach
4,473,869 A 9/1984 De Widt
4,588,248 A 5/1986 Moore
4,629,843 A * 12/1986 Kato ..... H05B 6/1245 174/396
4,631,648 A 12/1986 Nilssen
4,681,385 A 7/1987 Kruger et al.
4,753,600 A 6/1988 Williams
5,003,128 A 3/1991 Grondin
5,034,869 A 7/1991 Choi
5,173,053 A 12/1992 Swanson et al.
5,250,874 A 10/1993 Hall et al.
5,352,122 A 10/1994 Speyer
5,362,122 A 11/1994 Reihl et al.
5,438,216 A 8/1995 Juskey et al.
5,442,532 A 8/1995 Boulos et al.
5,494,325 A 2/1996 Liu et al.
5,494,326 A 2/1996 Hinds
5,536,685 A 7/1996 Burward-Hoy
5,551,882 A 9/1996 Whiteman
5,562,458 A 10/1996 Stora et al.
5,584,726 A 12/1996 Le Gallic et al.
5,600,537 A 2/1997 Gordin
5,622,873 A 4/1997 Kim et al.
5,668,920 A 9/1997 Pelonis
5,710,541 A 1/1998 Stanley
5,754,408 A 5/1998 Derouiche
5,777,391 A 7/1998 Nakamura et al.
5,790,381 A 8/1998 Derouiche et al.
5,803,590 A * 9/1998 Wedell ..... F21V 7/24 362/649
5,808,556 A 9/1998 Nelson
5,836,781 A 11/1998 Hyzin
5,952,714 A 9/1999 Sano et al.
5,962,810 A 10/1999 Glenn
6,068,490 A 5/2000 Salzberg
6,093,029 A 7/2000 Kwon et al.
6,129,598 A 10/2000 Yu et al.
6,135,800 A 10/2000 Majors
6,170,967 B1 1/2001 Usher et al.
6,175,159 B1 1/2001 Sasaki
6,240,247 B1 5/2001 Reiker
6,241,559 B1 6/2001 Taylor
6,332,794 B1 12/2001 Tzeng Jeng
6,340,790 B1 1/2002 Gordin et al.
6,364,716 B1 4/2002 Seo
6,366,733 B1 4/2002 Reiker
6,398,392 B2 6/2002 Gordin et al.
6,422,722 B1 7/2002 Voltolina
6,517,223 B2 2/2003 Hsu
6,595,782 B1 7/2003 Hsiao
6,598,990 B2 7/2003 Li
6,631,243 B2 10/2003 Reiker
6,648,488 B1 11/2003 Pearce
6,751,406 B2 6/2004 Reiker
6,793,383 B2 9/2004 Wu
6,821,089 B2 11/2004 Bilskie
6,837,754 B1 1/2005 Walton
6,962,498 B2 11/2005 Kohen
7,001,199 B1 2/2006 Badalpour
7,052,301 B2 5/2006 Garcia et al.
7,192,303 B2 3/2007 Kohen
7,462,066 B2 12/2008 Kohen
7,467,881 B2 12/2008 McMillen
7,706,757 B2 4/2010 Luglio et al.
7,723,862 B1 * 5/2010 Spillman ..... H05B 47/00 307/12
7,878,691 B2 * 2/2011 Liang ..... F21S 8/086 362/153
8,123,378 B1 2/2012 Ruberg et al.
8,357,016 B2 1/2013 Schumacher
8,558,413 B1 * 10/2013 Lepard ..... H05B 45/00 307/150
8,702,435 B2 4/2014 Tajima
8,894,247 B2 11/2014 Kim et al.
8,979,347 B2 3/2015 Holman
9,328,910 B2 * 5/2016 Lin ..... F21V 29/74
9,901,039 B1 2/2018 Dellerson et al.
9,903,576 B2 2/2018 Creasman et al.
10,317,015 B2 6/2019 Joye
10,326,247 B2 6/2019 Kohen
2002/0060369 A1 5/2002 Akram
2002/0064380 A1 5/2002 Reiker
2002/0081107 A1 6/2002 Reiker
2003/0012027 A1 1/2003 Hsu
2003/0107891 A1 6/2003 Kohen
2004/0192415 A1 9/2004 Luglio et al.
2005/0148241 A1 7/2005 Kohen
2006/0044789 A1 * 3/2006 Curtis ..... F21V 21/12 362/152
2006/0141842 A1 6/2006 Sauer
2006/0146527 A1 7/2006 Vanderschuit
2007/0105414 A1 5/2007 Kohen
2007/0167072 A1 7/2007 Kohen

(56) References Cited

U.S. PATENT DOCUMENTS

| | | | | |
|---|---|---|---|---|
| 2007/0258202 | A1* | 11/2007 | Cooley | H01R 31/065 361/679.4 |
| 2008/0146064 | A1 | 6/2008 | Bankstahl | |
| 2009/0035970 | A1 | 2/2009 | Kohen | |
| 2009/0111322 | A1 | 4/2009 | Roland | |
| 2009/0129974 | A1 | 5/2009 | McEllen | |
| 2009/0280673 | A1 | 11/2009 | Kohen | |
| 2010/0020550 | A1 | 1/2010 | Kawashima | |
| 2010/0214775 | A1* | 8/2010 | Liang | F21V 23/02 362/184 |
| 2010/0301769 | A1 | 12/2010 | Chemel et al. | |
| 2011/0060701 | A1* | 3/2011 | Verfuerth | F21V 21/30 705/500 |
| 2011/0134239 | A1* | 6/2011 | Vadai | F21S 2/00 348/143 |
| 2012/0196471 | A1 | 8/2012 | Guo | |
| 2013/0040471 | A1 | 2/2013 | Gervais et al. | |
| 2013/0107536 | A1 | 5/2013 | Hiraoka | |
| 2014/0168944 | A1 | 6/2014 | Osada et al. | |
| 2014/0211487 | A1* | 7/2014 | Spiro | F21V 23/06 362/382 |
| 2014/0225731 | A1 | 8/2014 | Gouveia | |
| 2014/0263903 | A1 | 9/2014 | Ostrobrod | |
| 2014/0268790 | A1 | 9/2014 | Chobot et al. | |
| 2015/0009666 | A1 | 1/2015 | Keng et al. | |
| 2015/0009676 | A1 | 1/2015 | Danesh | |
| 2015/0044040 | A1 | 2/2015 | Oda et al. | |
| 2015/0085500 | A1 | 3/2015 | Cooper | |
| 2016/0053952 | A1* | 2/2016 | Kuti | F21V 29/70 362/311.02 |
| 2016/0069556 | A1 | 3/2016 | Li | |
| 2016/0123374 | A1 | 5/2016 | Roberts | |
| 2016/0131358 | A1* | 5/2016 | Spiro | H01F 27/24 455/561 |
| 2017/0105265 | A1 | 4/2017 | Sadwick | |
| 2017/0234319 | A1 | 8/2017 | Seccareccia | |
| 2017/0248148 | A1 | 8/2017 | Kohen | |
| 2018/0115131 | A1 | 4/2018 | Kohen | |
| 2019/0312396 | A1 | 10/2019 | Kohen | |
| 2020/0018469 | A1 | 1/2020 | Kohen | |
| 2020/0144766 | A1 | 5/2020 | Kohen | |

FOREIGN PATENT DOCUMENTS

| | | | |
|---|---|---|---|
| CN | 101095268 | A | 12/2007 |
| CN | 102870307 | A | 1/2013 |
| CN | 104033399 | A | 9/2014 |
| DE | 19849101 | A1 | 4/1999 |
| DE | 29923352 | U1 | 8/2000 |
| DE | 20203467 | U1 | 6/2002 |
| EP | 0704934 | A2 | 4/1996 |
| EP | 1024559 | A2 | 8/2000 |
| EP | 1456914 | A1 | 9/2004 |
| EP | 1789984 | A2 | 5/2007 |
| IL | 126246 | | 8/2001 |
| RU | 2011122686 | | 10/2012 |
| RU | 2526853 | | 8/2014 |
| WO | 00/16442 | | 3/2000 |
| WO | 01/01047 | A1 | 1/2001 |
| WO | 03/044906 | A1 | 5/2003 |
| WO | 2005053100 | A2 | 6/2005 |
| WO | 2005/074087 | A1 | 8/2005 |
| WO | 2006031853 | A2 | 3/2006 |
| WO | 2006/060772 | A2 | 6/2006 |
| WO | 2006060772 | A2 | 6/2006 |
| WO | 2011/020231 | A1 | 2/2011 |
| WO | 2011/134709 | A2 | 3/2011 |
| WO | 2011/134709 | A2 | 11/2011 |
| WO | 2012/167320 | A1 | 12/2012 |
| WO | 2016054159 | A1 | 4/2016 |
| WO | 2016/144795 | A1 | 9/2016 |
| WO | 2016/183354 | | 11/2016 |
| WO | 2016183354 | A1 | 11/2016 |
| WO | 2018/165646 | | 9/2018 |
| WO | 2018/165058 | | 10/2018 |
| WO | 2018/195068 | | 10/2018 |

OTHER PUBLICATIONS

Written Opinion for International Application No. PCT/US2018/030372 filed May 1, 2018, 5 pages.

For Chinese Patent Application No. 201580063483.2 (national stage of PCT/US2015/053138): Third Office Action, dated Sep. 18, 2019 (with English translation) Response to THird Office Action, dated Dec. 2, 2019 (13 pages).

For Chinese Patent Application No. 201580063483.2 (national stage of PCT/US2015/053138): Response to First Office Action, dated Feb. 11, 2019 (9 pages) Response to Second Office Action, dated Aug. 26, 2019 (12 pages).

For Russian Patent Application No. 2016800404661 (national stage of PCT/US2016/032170): Second Office Action, dated Dec. 2, 2019 (3 pags) Search Report, dated Nov. 24, 2019 (2 pages).

For Indian Patent Application No. 201717013438 (National Stage of PCT/US2015/053138): First Examination Report, dated Dec. 13, 2019 (6 pages).

IAEI, When continuity snaps, May-Jun. 2015.

IAEI, Supports reinforce our safety, Hanging Support Systems, Mar.-Apr. 2015.

International Search Report, Written Opinion, International Preliminary Report on Patentability for PCT/US2004/039399 filed Nov. 22, 2004.

International Search Report, Written Opinion, International Preliminary Report on Patentability for PCT/US2005/032661 filed Sep. 14, 2005.

International Search Report, Written Opinion, International Preliminary Report on Patentability for PCT/US2005/043934 filed Dec. 2, 2005.

International Search Report, Written Opinion, International Preliminary Report on Patentability for PCT/US2015/53138 filed Sep. 30 2015.

International Search Report and Written Opinion for PCT/US2016/32170 filed May 12, 2016.

European Search Report for EP05796234 dated Nov. 5, 2007 (realted to WO2006031853).

International Search Report for PCT/IL01/01078 filed Nov. 22, 2001.

International Preliminary Report on Patentability dated Sep. 10, 2019 with Written Opinion for PCT/US2018/021919, filed Mar. 12, 2018.

International Search Report with Written Opinion dated Jul. 6, 2018 for PCT/US2018/027956.

Office Action dated Sep. 18, 2018 in U.S. Appl. No. 15/573,606.

Response filed Jan. 17, 2019, in U.S. Appl. No. 15/573,606.

Chinese Search Report dated Feb. 18, 2019 for Patent Application No. 2016800404661.

First Office Action dated Feb. 27, 2019 from Chinese Patent Office for Patent Application No. 201680040466.1.

Second Office Action for Chinese Patent Application No. 201580063483.2, dated Jun. 14, 2019 (with translation of cover page).

For Russian Patent Application 2017142137 (national stage of PCT/US2016/032170): Prosecution history including decision to grant dated Oct. 25, 2019.

Office Action issued by the European Patent Office dated Dec. 19, 2019 for Application No. 16 793 548.5-1201.

European Search Report for Application No. 16793548.5 dated Feb. 14, 2019.

Office Action for U.S. Appl. No. 16/491,321, dated Apr. 21, 2020.

International Search Report and Written Opinion for PCT/US2018/21919 filed Mar. 12, 2018.

International Search Report and Written Opinion for PCT/US2018/20987 filed Mar. 5, 2018.

European Search Report dated Jul. 3, 2018 for Application No. 15846948.6.

English translation of Search Report from Chinese Patent Office for Application No. 201580063483.2 dated Sep. 11, 2018.

(56) References Cited

OTHER PUBLICATIONS

Office Action from Chinese Patent Office for Application No. 201580063483.2 dated Sep. 25, 2018 (with English translation).
Final Office Action for U.S. Appl. No. 15/515,664, dated Mar. 10, 2020.
Office Action for U.S Appl. No. 16/443,207, dated Mar. 11, 2020.
International Preliminary Report on Patentability dated Nov. 14, 2017 for International Application No. PCT/US2016/032170 filed May 12, 2016.
Publication issued in the Official Gazette from Mexican Patent Application MX/a/2017/004137 dated Feb. 13, 2018, 3 pages.
International Search Report for PCT/IL99/00499 filed Sep. 14, 1999.
European Search Report for EP 01 27 4757 dated Mar. 28, 2006.
Australian Examiner's First Report on Patent Application AU 2002221000.
Indian First Examination Report dated Jun. 24, 2010 for Indian Application No. 1677/KOLNP/2006.
New Zealand Examination Report for NZ Patent Application No. 533697 dated May 9, 2007.
For Chinese Patent Application No. 01823877.7: Notice of Allowance dated Oct. 17, 2006 Second Office Action dated Apr. 6, 2007 First Office Action dated Jul. 4, 2006.
International Search Report with Written Opinion dated Aug. 13, 2018 for PCT/US2018/030372.
Office Action dated Sep. 25, 2018 from Chinese Patent Office for Application No. 201580063483.2.
International Search Report dated May 25, 2020, for PCT/US2020/019010 filed Feb. 20, 2020.
Written Opinion for PCT/US2020/019010 filed Feb. 20, 2020.
Office Action for U.S. Appl. No. 15/515,664, dated Sep. 10, 2019.
International Preliminary Report on Patentability dated Sep. 10, 2019 for PCT/US2018/020987, filed Mar. 5, 2018.
International Search Report dated Jul. 6, 2018 for PCT/US2018/027956 filed Apr. 17, 2018.
Written Opinion Jul. 6, 2018 for PCT/US2018/027956 filed Apr. 17, 2018.
International Search Report dated May 17, 2018 for PCT/US2018/021919 filed Mar. 12, 2018.
Witten Opinion for PCT/US2018/021919 filed Mar. 12, 2018.
International Preliminary Report on Patentability dated Sep. 10, 2019 for PCT/US2018/021919.
International Search Report dated Aug. 13, 2018 for PCT/US2018/030372 filed May 1, 2018.
Written Opinion dated Aug. 13, 2018 for PCT/US2018/030372 filed May 1, 2018.
International Preliminary Report on Patentability dated Oct. 22, 2019 for PCT/US2018/027956.
International Search Report dated Jul. 18, 2016 for International Application No. PCT/US2016/032170 filed May 12, 2016.
Written Opinion for for International Application No. PCT/US2016/032170 filed May 12, 2016.

* cited by examiner

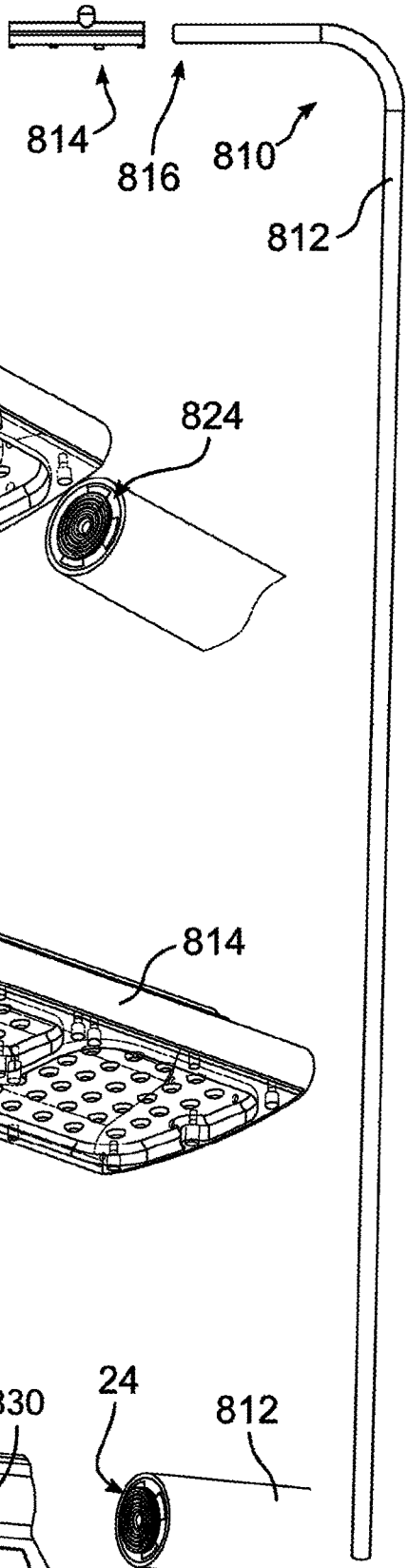
FIG. 1
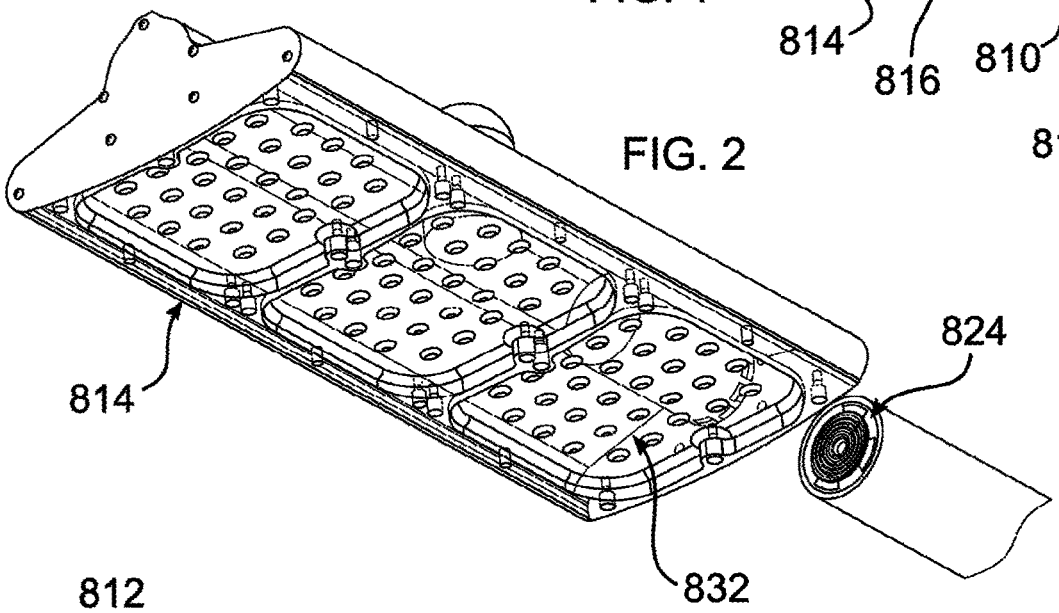
FIG. 2
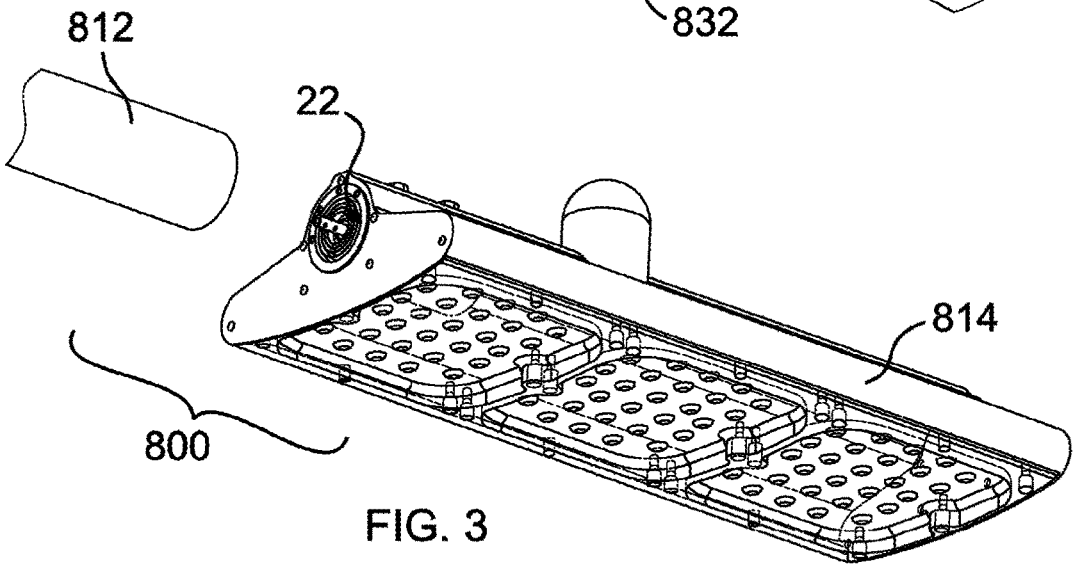
FIG. 3
FIG. 4
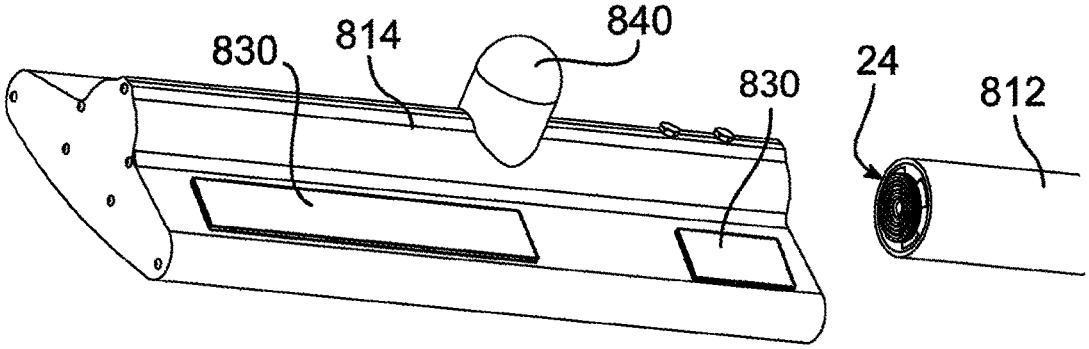

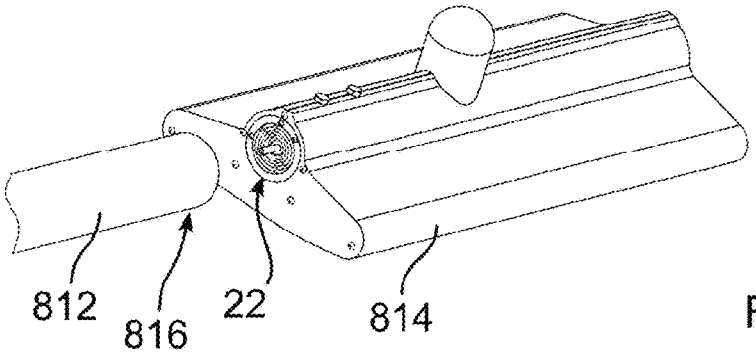
FIG. 5
FIG. 6
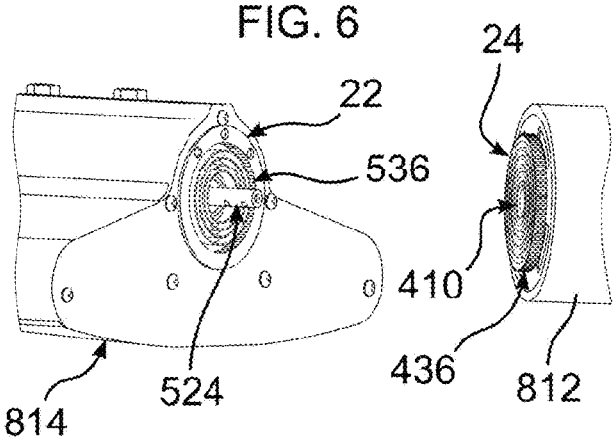
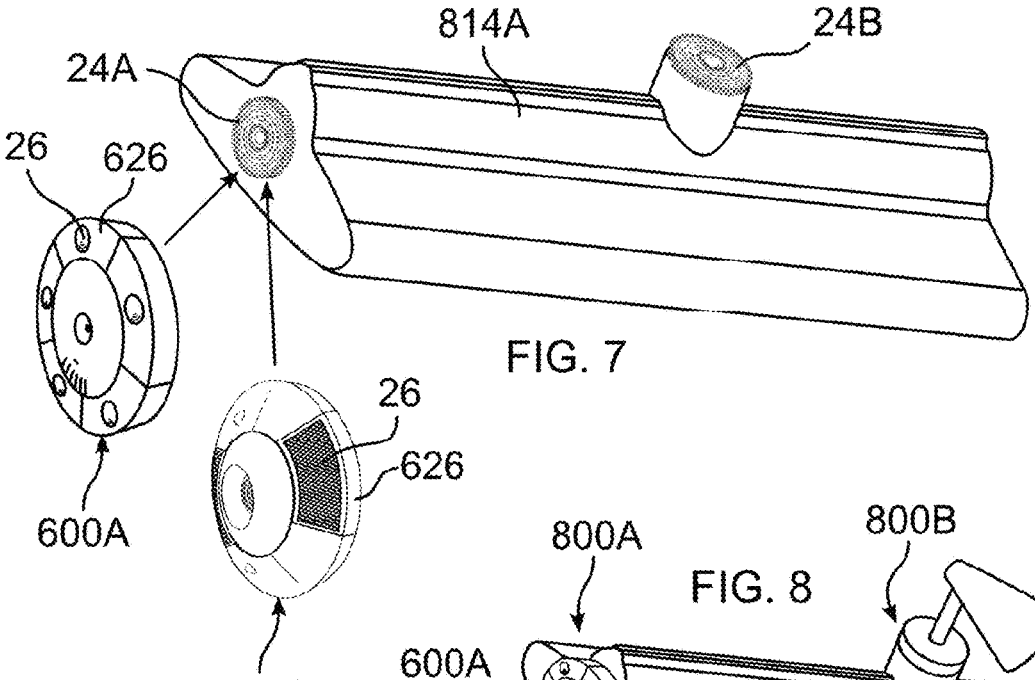
FIG. 7
FIG. 8
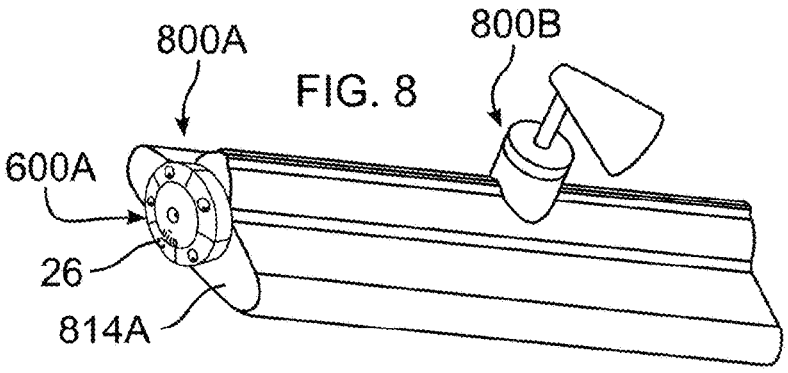

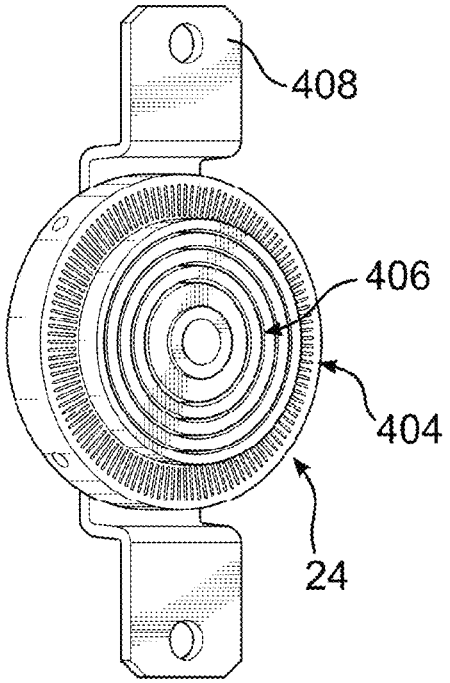
FIG. 13
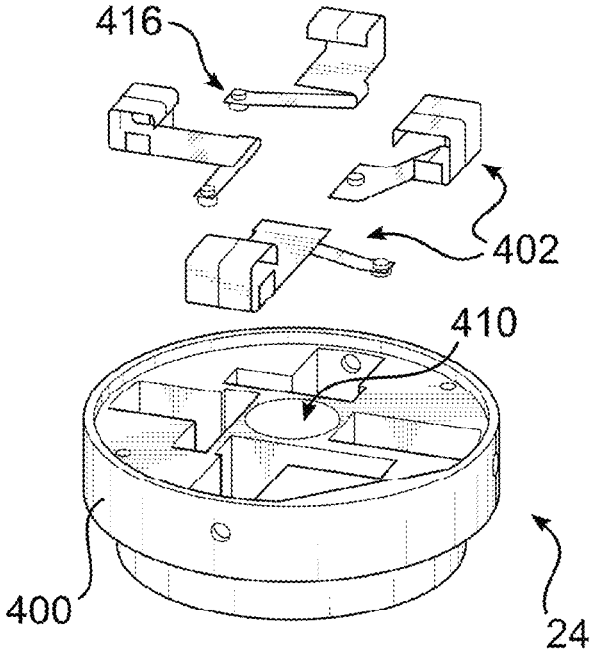
FIG. 15
FIG. 14
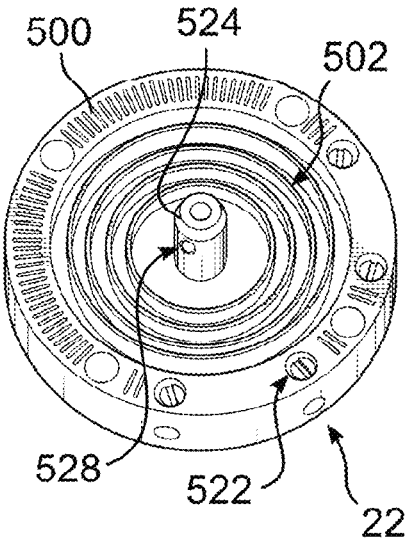
FIG. 16
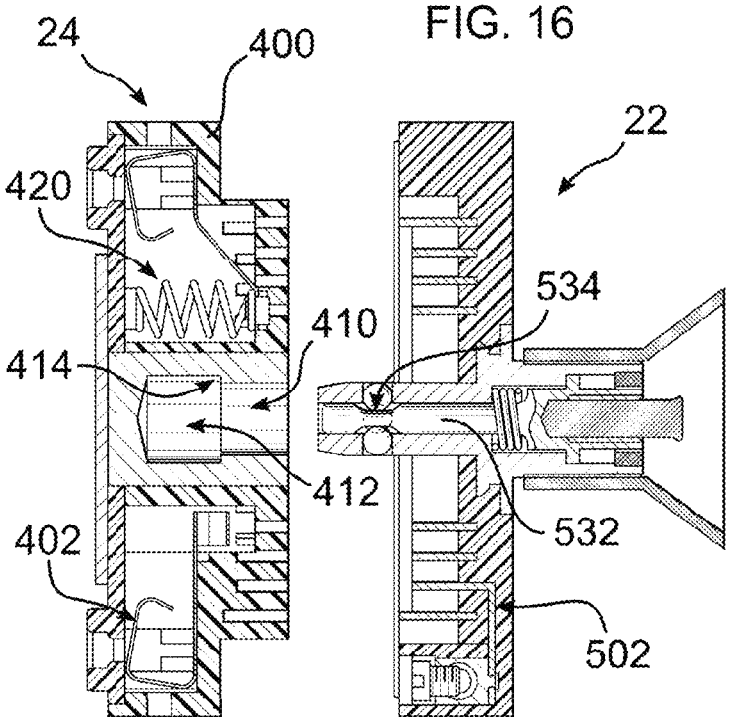

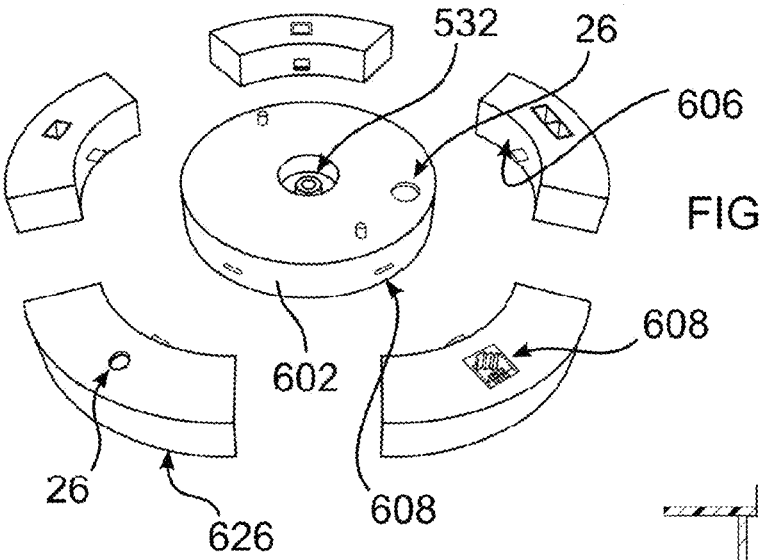
FIG. 20
FIG. 21
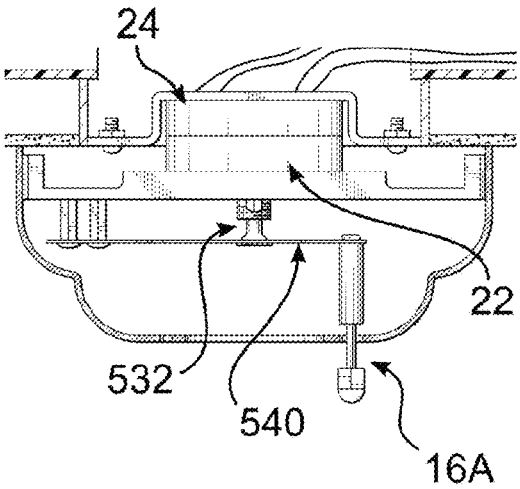
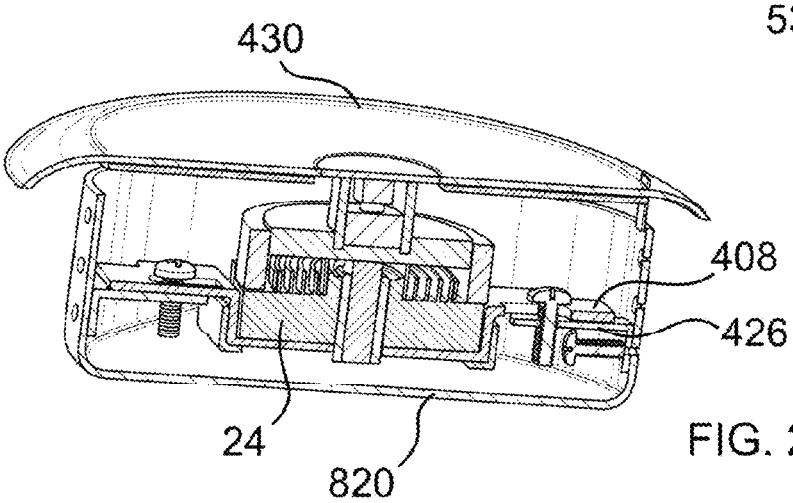
FIG. 22
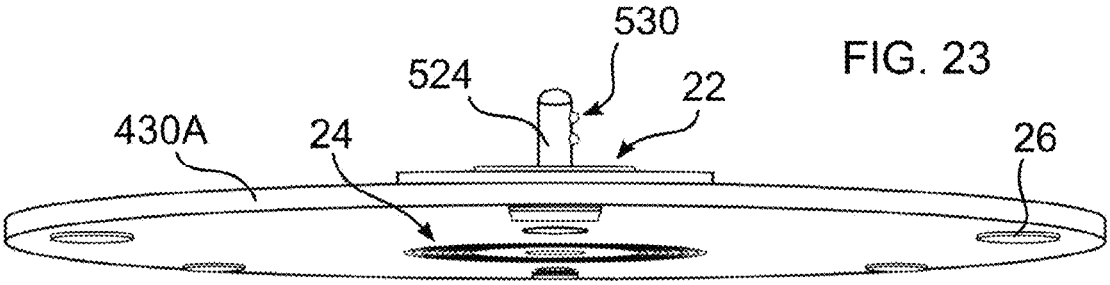
FIG. 23

CONNECTING LIGHTING TO POLES WITHOUT TOOLS

FIELD OF THE DISCLOSURE

The disclosure relates to a system and method for connecting light fixtures and other electrical devices to lamp or utility poles, and in particular, to forming such mechanical and electrical connections without using tools.

BACKGROUND OF THE DISCLOSURE

Techniques for installing electrical fixtures and appliances such as lighting fixtures and fans on walls or ceilings usually require the assistance of a qualified electrician, and the use of a variety of tools and specialized hardware. The procedure for installing or uninstalling such fixtures can also be relatively time consuming, even when performed by an experienced installer, and can be hazardous. In addition to the need for hand-wiring the necessary electrical connections between the fixture and electrical power supply wiring, the installer must make separate mechanical connections for supporting or suspending the fixture in place. This is particularly difficult when such devices are mounted to the end of elevated poles, or are suspended above traffic, for example.

There are a number of commercially available systems termed 'smart-home environment' systems, which can include one or more sensors and network-connected devices. These smart-home devices can sometimes intercommunicate and integrate together within the smart-home environment. The smart-home devices may also communicate with cloud-based smart-home control and/or data-processing systems in order to distribute control functionality, to access higher-capacity and more reliable computational facilities, and to integrate a particular smart home into a larger, multi-home or geographical smart-home-device-based aggregation.

A street light (also known as a light pole, lamppost, street lamp, light standard, or lamp standard) is a raised source of light typically on the edge of a road or walkway, or extending above the roadway. Modern street lights may also have light-sensitive photocells that activate automatically when light is or is not needed, such as at dusk, dawn, or the onset of overcast weather. Street light systems are often connected to a source of electricity by wires passing underground instead of with wiring extending from one utility post to another.

In some cases, hard-wiring connections to or from a street light is not necessary as some street lights have photovoltaic cells and collect and store the electrical energy needed for the street light during daylight hours. Additionally, street lights can have radio transmitters and/or receivers to wirelessly transmit information and/or receive information (such as turn on/turn off command signals).

Street lights use high-intensity discharge lamps, often HPS high pressure sodium lamps, or metal halide lamps. Newer street lighting technologies, such as LED or induction lights, have also been introduced as they emit a white light that provides high levels of scotopic lumens allowing street lights with lower wattages and lower photopic lumens to replace existing street lights.

SUMMARY OF THE DISCLOSURE

A device of the disclosure comprises a pole of at least 6 feet in length; an electrical socket affixed to an end of the pole, the socket including a body having an interior, a cover positioned on the body to cover the interior of the body, the cover having a plurality of ring-shaped openings therethrough providing passage into the interior of the body, a plurality of resiliently mounted electrical contactors each positioned in the interior of the body and adjacent to one of the plurality of ring-shaped openings in the cover; a central bore extending through the body along an axis about which the plurality of ring-shaped openings of the cover; and a ledge extending radially outwards from the central bore at a side of the body opposite to a side of the body upon which the cover is positioned.

In variations thereof, the device is a mount to which a street lamp is directly connectable; and/or the device further includes a street lamp directly connected to the socket.

In another variation thereof, the socket is the type configured to mechanically and electrically connect to a plug having a series of concentric conductive rings positioned to dispose one concentric ring into each ring-shaped opening of the cover when the plug and socket are mated, a post insertable into the central bore of the socket, the post having a central bore and at least one transverse bore through the post that is transverse to the central bore of the post, a spherical bearing positioned within the at least one transverse bore, and a rod having a depressed radial groove formed therein, the rod insertable into the central bore of the post, the rod slideable within the central bore of the post to align the groove with a transverse bore in an unlock position, and to move the groove away from alignment with a transverse bore in an unlocked position.

In additional variations thereof, the socket includes a peripheral gear formed about an exterior surface of the body adjacent the cover; the socket and the plug each include a peripheral gear formed about an exterior surface of the body adjacent the cover, and gear of the socket mateable with the gear of the plug to maintain a radial orientation of plug with respect to the socket; the device further includes a device including at least one of the plug, the device thereby mechanically and electrically connectable to the socket, the device thereby mechanically and electrically connectable to the pole; and/or the device is a lamp head including at least one source of electrically activated illumination.

In a yet further variation thereof, the device further includes a connectable device to which a plug is affixed, the plug having a series of concentric conductive rings positioned to dispose one concentric ring into each ring-shaped opening of the cover when the plug and socket are mated, a post insertable into the central bore of the socket, the post having a central bore and at least one transverse bore through the post that is transverse to the central bore of the post, a spherical bearing positioned within the at least one transverse bore, a rod having a depressed radial groove formed therein, the rod insertable into the central bore of the post, the rod slideable within the central bore of the post to align the groove with a transverse bore in an unlock position, and to move the groove away from alignment with a transverse bore in an unlocked position.

In further variations thereof, the device includes at least one sensor for sensing and signaling a parameter of the environment of the pole when the device is connected to the pole using the plug and socket; the sensor is selected from the group comprising microphone, speaker, light sensor, visible or non-visible light detecting camera, chemical sensor, motion sensor, temperature sensor, humidity sensor, wind sensor; the device further includes an electronic processor, the device further includes a lamp for producing visible light; the connectable device includes a lamp; the lamp further includes a socket of the type connected to the pole; the connectable device includes one or more sensors, the sensors emitting an electrical signal that is communicated through the plug and socket.

In other variations thereof, the connectable device is a traffic signal light; the device further includes a collar affixed to the connectable device sized to conformingly surround the pole to provide support for a mechanical connection of the pole and the connectable device when the plug is connected to the socket; the device further includes an access port formed in at least one of the collar and the pole to admit passage of a hand or tool proximate the socket and plug to thereby facilitate release of the socket from the plug by movement of the rod; and/or the pole extends at least 12 feet above a mounting surface, when the pole is mounted upon a mounting surface.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein:

FIG. 1 depicts a pole, lamp head, and connection of the disclosure, the lamp head disconnected from the pole;

FIG. 2 depicts a closer perspective of the lamp head, pole, and socket connector, in accordance with the disclosure;

FIG. 3 depicts the lamp head and connection of FIG. 1, showing a plug mateable with the socket shown in FIG. 2;

FIG. 4 depicts a top perspective view of the lamp head and socket of FIG. 1, and further illustrates additional devices that can be associated with the lamp head, such as a solar panel, battery, sensor, and/or a transmitter;

FIG. 5 is a top perspective view of the pole, lamp head, and connection of FIG. 1;

FIG. 6 is a detail view of the connection of FIG. 1, illustrating an optional mating gear connection for setting and maintaining a radial orientation of the lamp head;

FIG. 7 depicts a lamp head of FIG. 1, further including additional sockets of the type shown in FIG. 2, and additionally illustrating devices which can connect to the additional socket, such as devices including sensors;

FIG. 8 depicts the lamp head of FIG. 7, with a sensor device and additional light connected to the additional sockets;

FIG. 13 depicts a detailed perspective view of a socket, the socket having gear teeth which are oriented along an axis that is transverse to an axis of the central bore of the socket;

FIG. 14 depicts a detailed perspective view of a plug, the plug having gear teeth mateable with the gear teeth of FIG. 13, to maintain a relative radial orientation of a mated plug and socket;

FIG. 15 depicts an exploded view of a body of a socket, including contactors and resilient contactor supports;

FIG. 16 depicts a cross-section through the middle of a socket and plug;

FIG. 20 depicts a modular sensor device having a plug of the type of FIG. 19 mounted to a central hub, the hub electrically connected to a plurality of modules, each module contributing a feature to the assembly of hub and modules, the features including sensors, such as detectors, emitters, and transducers;

FIG. 21 depicts an alternative release mechanism to separate a mated socket and plug;

FIG. 22 depicts a detailed view of a support sleeve for a socket or plug, and a cover; and FIG. 23 depicts a cover including a plug of the type shown in FIG. 3 or 18, the cover optionally including one or more sensors, and optionally including a socket of the type shown in FIG. 6 or 13.

DETAILED DESCRIPTION OF THE DISCLOSURE

Figure 9:
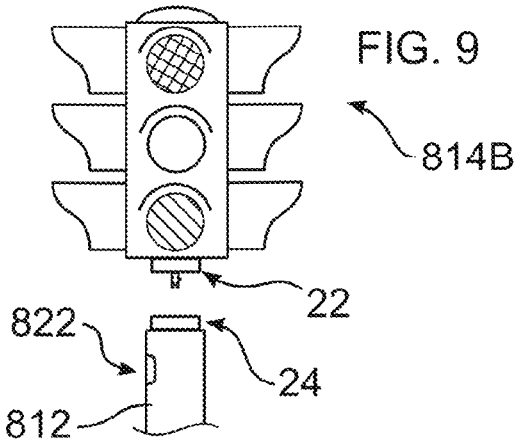
FIG. 9 depicts a traffic signal light mounted to a vertically extending pole and connector in accordance with the disclosure.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Street lights of all types typically include a pole that supports and holds the lamp head in a desired position. Thus, irrespective if one desires to convert an existing street light to LED (or some other new technology) or simply repair/replace a defective lamp head, separation of the lamp head from the pole and reconnection of the lamp head to the pole are required.

Traditional techniques for installing street light lamp heads to poles usually require the assistance of a qualified electrical team, and the use of a variety of tools and specialized hardware. The procedure for installing or uninstalling such lamp heads can also be relatively time consuming, even when performed by an experienced team. In addition to the need for hand-wiring the necessary electrical connections between the lamp head and electrical power supply wiring, the installer must make separate mechanical connections for supporting or suspending the lamp head in place. During this time, the team and other people can be vulnerable to accidental harm due to the passage of traffic of all types, and traffic may be impeded.

According to the disclosure, a lamp head and associated equipment can be removed very quickly, without a requirement for tools, at least for the mechanical and electrical connection provided by socket 24 and plug 22, enabling a technician to block or be in traffic for only a very brief time period. The lamp head can be quickly swapped out, and the technician can leave immediately and not need to return, resulting in the briefest exposure to traffic, or impeding of traffic. The replaced head can be tested, serviced, or replaced on the ground, away from traffic, and can then be used to swap out another fixture in a similar manner.

Patent publications of the inventor disclose solutions to connecting lighting and other electrical and electronic fixtures without the use of tools. These related patents and applications disclose various embodiments of plug 22 and socket 24 combinations that permit quick connection of an electrical fixture or appliance at an electrical junction box on a wall or ceiling. For example, the socket is secured on the wall or ceiling near electrical power supply wiring and includes female receptacles which receive male electrical prongs carried on the plug. The electrical fixture is secured to the plug using any of a variety of known means. In addition to the quick and safe electrical connection provided by this plug and socket combination, a mechanical connection between the plug and socket carries the mechanical load of the electrical fixture.

More particularly, sockets and plugs referred to herein are of the types described in U.S. Patent Application Ser. No. 62/467,176 filed Mar. 5, 2017; PCT International Patent Application No. PCT/US2016/032170 filed May 12, 2016 (published as WO 2016/183354 A1); U.S. Pat. No. 7,462,066 filed Mar. 20, 2007; U.S. Pat. No. 7,192,303 filed Dec. 2, 2004; and U.S. Pat. No. 6,962,498 filed Dec. 12, 2001; and U.S. Patent Application Publication No. 2009/0280673 filed Dec. 2, 2005, U.S. Provisional Applications 62/160,585 filed May 12, 2015; 62/308,718, filed Mar. 15, 2016; 62/467,176 filed Mar. 5, 2017; 62/470,170 filed Mar. 10, 2017; and 62/515,464, filed Jun. 5, 2017. The published documents describe the sockets and plugs in great detail, and reference may be had thereto for additional detail not provided herein. Notwithstanding the foregoing, the contents of each of the foregoing documents are herein incorporated in their entirety by reference.

Previous disclosures of the inventor, some of which are cited above, describe a socket 24 which admits a plug 22 for conducting electric power to a light 14, fan or other suspended fixture. The plug mechanically supports the weight of the fixture, in a desired orientation, so that the fixture can also receive power from the plug. A central releasable latching mechanism allows partial or total withdrawal of the plug. Partial withdrawal is used to support the weight of the fixture while a change is made to the rotational orientation of the fixture. Total withdrawal is used to transfer the fixture to another location.

As applied to this disclosure, the term "fixture" or "electrical fixture" refers to a lamp head 814 of a street light 810 as lamp head 814 is powered by electricity supplied by electrical wiring, and requires a mechanical connection to support or suspend the lamp head from the pole of street light 810. The structure, function, and operation of the plug 22 and mating socket 24 are detailed herein and also in, for example, the patents and applications incorporated by reference herein, and reference may be had thereto for additional details regarding the quick release fixture generally, as well as to variations thereof which can all be used in combination with the disclosure.

The disclosure applies equally to lamp heads 814 which include an integrated source of electricity, such as solar panels or a wind generator. In some cases, the generated electricity may pass through the socket 24 and plug 22 to an external storage device. Alternatively, generated electricity may be stored within the lamp head, and the socket and plug 24/22 may only pass control signals. Finally, lamp head 814 may be generally autonomous, including for example electricity generation, storage, and a timer or light sensor to control operation; however an override signal, or alternatively power and signal lines for a separate device that is connected to lamp head 814 may pass through socket 24 and plug 22.

As shown in FIG. 1, a street light 810 includes a pole 812 and a lamp head 814. Street light 810 can also include one or more solar cells 830, wireless transmitter/receiver 840, or any other device which can be associated with street lighting technology, or which are disclosed herein, including for example the devices shown and described with respect to FIGS. 7-8. The disclosure further contemplates that pole 812 can have any suitable shape and/or size, including oval or polygonal cross-section, or a uniform or tapering length.

Although lamp head 814 is shown as an LED array 832 in the figures, any suitable light source can be used, including LED, fluorescent, incandescent, halogen, HID, metal halide, mercury vapor, and low or high-pressure sodium, as examples. In an embodiment, to reduce weight of head 814, or for any other reason, any required ballast can be stored in or on pole 812, upon a base of pole 812, or at any other location, connected to head 814 by wires which are interconnected by socket 24 and plug 22. In such an event, plug and socket 22/24 should be suitably rated for the applicable voltage and current used.

As shown in FIGS. 2-6, the mechanical and electrical connection 800 (indicated by braces in FIG. 3) between pole 812 and lamp head 814 is made with a quick connect device which comprises the combination of a plug 22 and a mating socket 24. As shown, plug 22 is fixedly secured to lamp head 814, while socket 24 is secured to pole 812. However, the disclosure contemplates that plug 22 can be located on pole 812 and socket 24 can be located on lamp head 814.

As can be seen in FIGS. 1-4, pole 812 is elongate and extends to a height which disposes a free end 816 at a distance above ground which is normally higher than most humans can reach, unaided. Such height can be at least 6 feet, but may be at least 12 feet to enable cars to pass thereunder, and at least 14 feet to allow tractor trailers to pass thereunder. Rules of the U.S. Department of Transportation suggest that when placed adjacent to interstate highways and extending over the roadway, the height of the end of pole 812 and lamp head 814 must be at least 16 feet in rural areas and 14 feet in urban areas. However, in accordance with the disclosure, this height is at least 6 feet and up to at least 100 feet or more. Pole 812 can be mounted to another structure, disposing free end 816 at extreme heights of hundreds of feet. Working on installing, repairing, and removing lamp heads 814 at great heights increases the danger to human technicians. The disclosure enables such exposure to heights to be as brief as possible. Further, due to the simplicity of operation of connection 800, mechanical or robot devices can be used to connect and release connection 800, thereby avoiding a need to place humans in a potentially perilous position.

In the figures, and particularly in FIG. 6, it may be seen that socket 24 includes a radial gear 436 formed upon a surface of socket 24. A mating peripheral gear 536 is provided upon plug 22, whereby when plug 22 and socket 24 are mated, gears 436, 536 mate to maintain a radial orientation of lamp head 814 with respect to the free end 816 of pole 812. More particularly, a desired angular orientation of lamp head 814 is established before socket 24 and plug 22 are sufficiently joined to engage gears 436 and 536. When the desired angle is established, socket 24 and plug 22 are fully mated to mesh gears 436 and 536. In this manner, light from lamp head 814 can be directed at an angle that is desired and which is optimally effective for a particular task. Post 524 can be partially inserted into channel 410 to bear at least a portion of the weight of lamp head 814 as lamp head 814 is rotated to the desired angle.

Turning now to FIGS. 7-8, it may be seen that head 814 can be provided with additional sockets 24 (here 24A, 24B), which enable the mechanical and electrical connection 800 (here 800A, 800B) of additional electrical devices, each having a plug 22 (not depicted in FIGS. 7 and 8, but depicted elsewhere herein, and in the incorporated references). Any number of such additional sockets 24/plugs 22 can be provided upon lamp head 814.

In particular, in the example of FIGS. 7-8, a smart device 600 (here 600A, 600B) as described in the incorporated references and elsewhere herein includes a plug 22 which is connectable to a socket 24 (here 24A) which is mounted upon lamp head 814 (here 814A). FIG. 8 depicts smart device 600A mounted upon lamp head 814A. Wires can thus pass from device 600A into lamp head 814A, to obtain power available in lamp head 814A, or to connect to a transmitter or other device within lamp head 814A. Additionally or alternatively, electrical power or signal can pass from a smart device 600 through socket 24A/plug 22, and wires connected to socket 24A can in turn be connected to socket 24 of lamp head 814. As a result, electrical connection 100 can pass power and/or signal from both lamp head 814 as well as devices connected to lamp head 814 via sockets 24/plugs 22.

An advantage of providing a smart device 600 is that various sensors 26 or sensing modules 626 can be incorporated and quickly exchanged as needed or desired, and which can provide useful information relevant to the environment of lamp head 814. For example, sensors 26 or sensing units 626 can be provided for any combination of the following functions throughout a region in which one or many lamp heads 814 are deployed, for example throughout a parking garage or a city:

measuring temperature, humidity, wind or other environmental parameter, to address climate control problems, or to report weather;

monitoring for sounds, such as glass breaking, gunfire, or cries for help, to summon first responders;

monitoring for ambient light, for example to turn lights of lamp head 814 on or off;

broadcasting sounds, such as an emergency alert, or safety warnings or instructions;

detecting motion, for security, to open doorways or pathways, or to otherwise sense and control traffic or traffic lights;

recording activity in the environment surrounding pole 814 using a camera detecting visible or non-visible light, including for example infrared energy;

monitoring for chemical release, or the presence of toxic or dangerous substances such as explosives or radiation emitting substances; and/or other functions which could be implemented by sensing units 26 as defined herein and in the incorporated references, and which include, for example, receivers/transmitters 58/50.

In FIG. 8, an additional lighting head 814C is connected to socket 24B by a plug 22 (not visible in FIG. 8), illustrating that multiple light heads 814 of a like or dissimilar structure can be mutually interconnected, or daisy-chain configuration. In the example shown, lamp head 814C is a spot light, which can be used to illuminate a zone that is dark when there is low ambient light, and which is not otherwise illuminated by lamp head 814A. For example, a waiting area can be provided with additional light in this manner, improving security. While this additional socket 24B is illustrated on an upper surface (when lamp head 814A is installed), a socket 24 can be provided on any orientation upon a lamp head 814.

Figure 10:
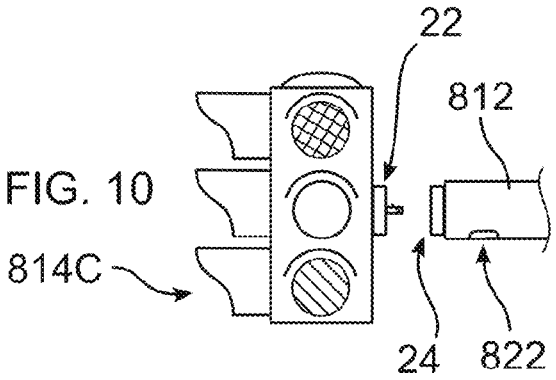
FIG. 10 depicts a traffic signal light mounted to a horizontally extending pole and connector in accordance with the disclosure.

In FIGS. 9-10, lamp head 814 (here 814A/814B) has a highly specific structure and purpose, that is unrelated to general lighting for visibility. In this example, a traffic light is depicted, which can include various color coded lights for controlling vehicular traffic, such as red, yellow, and green lights in the U.S. and in other countries. Other types of signal lighting can be deployed in this manner, for example illuminated signs containing text or other indicia, which may control traffic, or otherwise signal a warning or other condition. In FIG. 9, lamp head 814B is mounted with in a vertical orientation with respect to ground, with pole 812 likewise having a vertical orientation. In FIG. 10, pole 812 has a horizontal orientation, while lamp head 814C again has a vertical orientation. These and other relative orientations between lamp head 814 and pole 812 can be obtained by changing the orientation of pole 812, including non-orthogonal orientations, and changing a mounting location of socket 24/plug 22 upon lamp head 814.

Figure 11A:
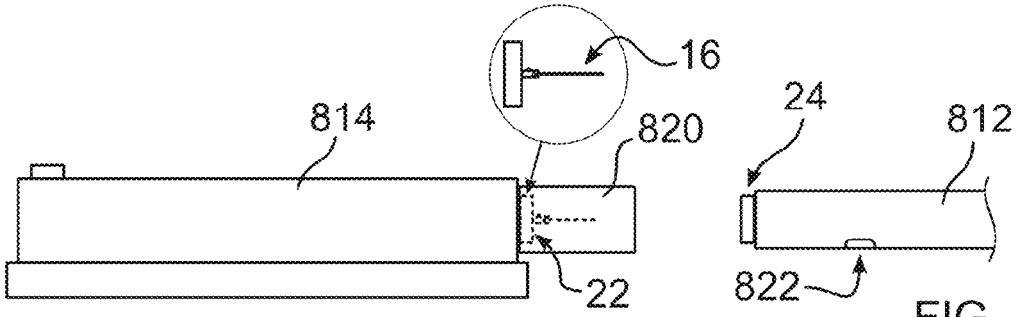
FIG. 11A depicts an assembly of a lamp head, pole, and connector of FIG. 1, further including a collar surrounding a plug, in accordance with the disclosure, and further including an access port in the pole.
Figure 11B:
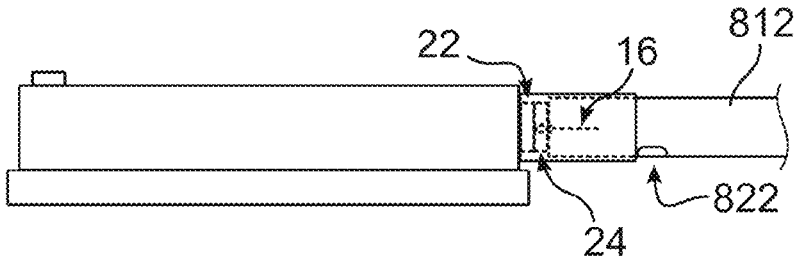
FIG. 11B depicts the assembly of FIG. 11A in a connected orientation.
Figure 12A:
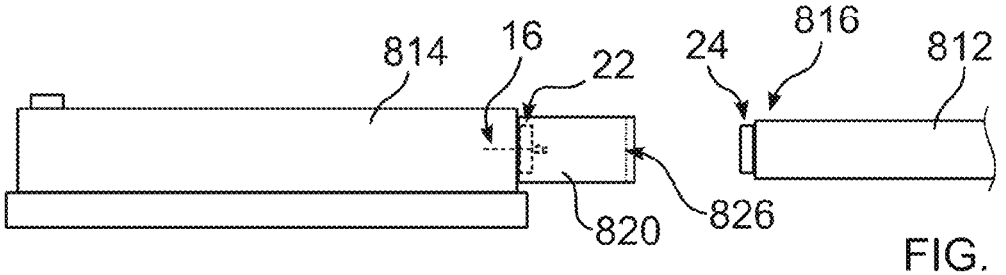
FIG. 12A depicts the assembly of FIG. 11A, with the release rod extending into the lamp head.
Figure 12B:
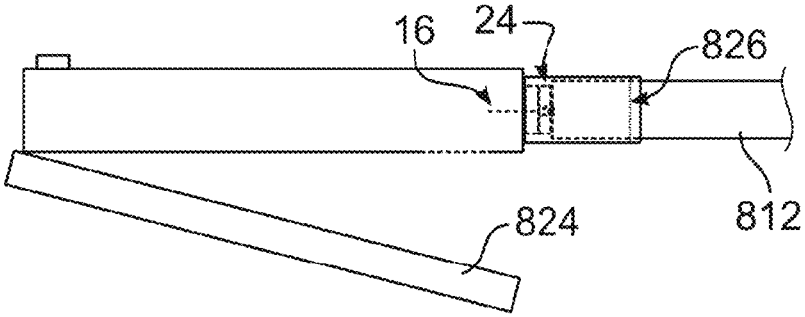
FIG. 12B depicts the assembly of FIG. 12A, with the lamp head opened to enable access to the release rod.

With reference to FIGS. 11-12A, a collar 820 is secured to lamp head 814, surrounding plug 22 (shown enlarged and not hatched, within an adjacent circle, for clarity). Pole 812 is insertable into collar 820 to connect socket 24 and plug 22 as otherwise described herein. As such, collar 820 provides additional strength for connection 100, preventing pole 812 from bending excessively, or for an excessive amount of force to be applied to the mechanical connection between socket 24 and plug 22. This can be helpful to prevent damage due to high winds, roosting birds, or vandalism, for example. Collar 820 can be provided for other configurations of socket 24 and plug 22, as described herein or in the incorporated references. Additionally illustrated in FIGS. 12-12A is a ring seal 826, for example an O-ring, disposed between collar 820 and pole 812 when mutually assembled. Seal 826 can be affixed to either collar 820 or pole 812, for example by being resiliently retained within a groove (not shown). Seal 826 reduces entry of water or other contaminants, or insects.

Collar 820 can alternatively be connected to pole 812, and a connectable device can include one or a plug 22 or socket 24 mounted on a sleeve which extends into collar 820. Alternatively, other mechanical connectors associated with pole 812 and a connectable device can complement the mechanical connection provided by plug 22 and socket 24, to provide additional mechanical support as needed.

With additional reference to FIGS. 9-12A, an access port 822, which may be covered by a plug or door (not shown), provides access within pole 812 in order to actuate a release push rod 16 or other release mechanism described herein or in the incorporated references. Actuation of push rod 16, for example pushing rod 16 against a biasing force, enables a separation of socket 24 and plug 22. An access port 822 can alternatively or additionally be provided within collar 820, to provide closer access to plug 22/socket 24.

In FIGS. 12-12A, rod 16 extends in a reverse direction into an interior of lamp head 814. Access to rod 16 is therefore through the interior of lamp head 814, for example by opening a lens or cover 824, as shown in FIG. 12A. This can be advantageous, for example, to discourage theft or vandalism.

Herein, it should be understood that a relative position of a socket 24 can be exchanged with a plug 22. That is, where a socket 24 is depicted, a plug 22 could be provided, with a corresponding substitution of a plug 22 with a socket 24 on the mating device. Generally, however, a power source is applied to a socket, to prevent electrical contact of the power signal with a grounded object or a person or animal when a connection 100 is not formed and a socket/plug is exposed. For low power signals, however, this may be less of a concern, and there is thus more design leeway in terms of which device has a socket 24, and which has a plug 22.

Socket 24 or plug 22 can be affixed to either a lamp head 814 or pole 812 by any known or hereinafter developed means, including brackets, screws, clamps, threading, adhesive, press-fit, welding, or brazing, for example. Any gap or opening past socket 24 or plug 22 into an interior of pole 812 or lamp head 814 can be sealed by a suitable caulking, adhesive, gasket, paint, or other means. A cap or cover (FIGS. 22, 23) can be applied to socket 24 or plug 22 when not mutually connected, to prevent the entrance of contaminants, or to reduce an incidence of corrosion, tampering, or damage.

Figure 17:
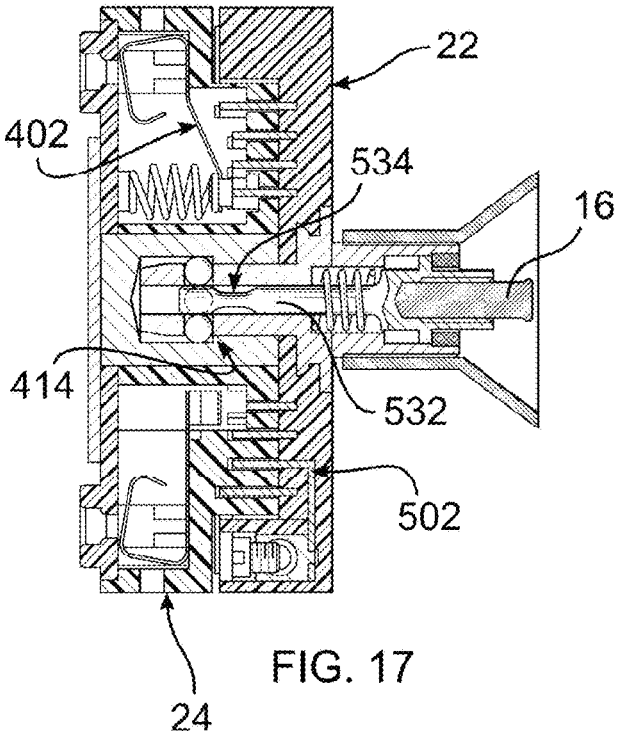
FIG. 17 depicts the socket and plug of FIG. 16, mated.

With reference to FIGS. 13, 15, and the left side portions of FIGS. 16 and 17, embodiments of a socket 24 are depicted in detail. In FIG. 15, it may be seen that socket 24 includes a non-conductive body 400 which houses a plurality of resilient contactor supports 402 including contacts 416 positioned at the end of extensions 418. A spring 420 (FIG. 16) can be positioned behind each contact 416 to bias the contact into a position within a channel 406 described further below. A cover 404 encloses supports 402 supported within body 400, and includes a series of concentric channels 406 which expose a support 402 within each channel 406. Supports 402 can be conductive, and can include a threaded aperture (not depicted) or other fastener to which an electrical wire lead can be electrically connected to the support 402, and thereby to contacts 416. A bracket 408 can be mounted to socket 24 to facilitate mounting socket 24 within or upon a pole 812, or within or upon a lamp head 814. Cover 404 can alternatively be integrally formed with body 400, and an opening can be provided in the body for insertion of conductors 402. In a further alternative, socket 24 is digitally printed with an enclosed body housing conductors 402 and other components described herein, and with channels 406 formed therein.

As can be seen in FIG. 16, socket body 400 includes a bore 410 which leads to a bore 412 of greater diameter, the two bores 410, 412 thereby mutually forming a ledge 414. While bore 410 and 412 form a closed-ended bore, bore 410 can lead completely through body 400, to enable passage of a release push rod 16, as discussed elsewhere herein. Ledge 414 can alternatively be formed upon a surface of body 400 that is opposite to the side having cover 404, where bore 410 extends completely through body 400.

Figure 18:
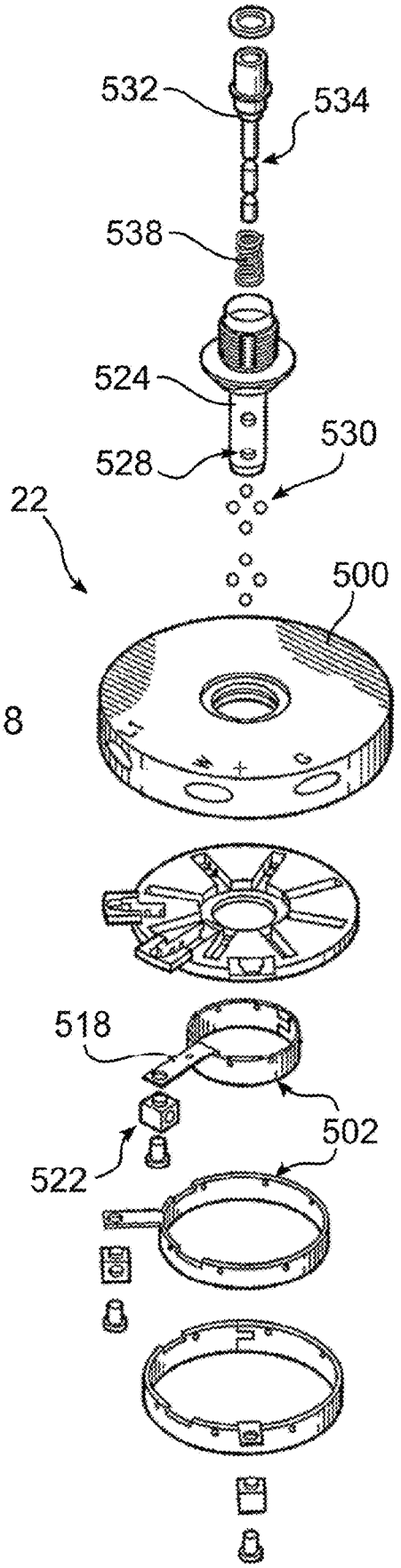
FIG. 18 depicts an exploded view of a plug.
Figure 19:
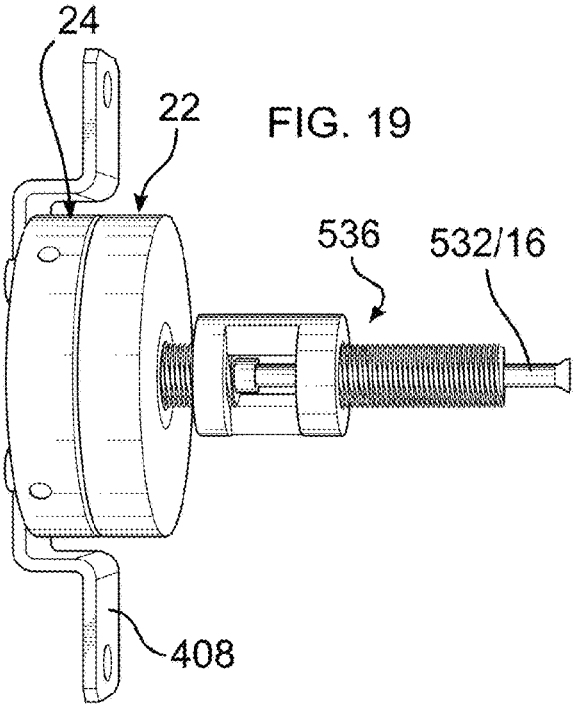
FIG. 19 depicts a detailed perspective view of a mated plug and socket, with an extended release rod and support.

With reference to FIGS. 18 and 19, and the right side portions of FIGS. 16 and 17, a plug 22 includes a base 500 with a central bore 510 which houses a series of concentric ring-shaped conductors 502 positioned coaxially to central bore 510, conductors 502 include extensions 518 terminating in terminals 522 to which an electrical wire lead can be electrically connected to each conductor 502.

A cylinder post 524 passes through central bore 510 and is affixed to base 500. Post 524 includes a central bore 526, and one or more transverse bores 528 which are disposed with a transverse axis with respect to central bore 526. Bores 528 are shaped to retain ball bearings 530 therein, while enabling them to pass at least partially outside bore 528 to project from an exterior of post 524. A retaining rod 532 is sized to slidingly pass through central bore 510, and includes one or more peripheral depressed ring channels 534 formed in a surface thereof. When rod 532 is disposed to move to a release position within bore 510, a ring channel 534 is aligned with a transverse bore 528, and a bearing 530 is permitted to enter ring channel 534, whereupon no portion of bearing 530 projects from an exterior of post 524. As rod 532 is moved to a lock position, a ring channel 534 is positioned away from alignment with a transverse bore 528, wherein bearing 530 is pushed by rod 532 so that a portion of bearing 530 must project from an exterior of post 524, and cannot fully enter transverse bore 528. A spring 538 biases rod 532 into the lock position.

As can be seen in FIGS. 17 and 19, as socket 24 and plug 22 are mated, ring-shaped conductors 502 of plug 22 are inserted into channels 406 of socket 24, to each contact and form an electrical connection with a conductor 402. Post 524 has a diameter that closely fits within bore 410, whereby it is necessary to move rod 532 to the release position, enabling all bearings 530 to move into transverse bore 528 and not extend from post 524. When socket 24 and plug 22 are fully mated and contact has been formed, rod 532 can be released to the lock position, whereupon a portion of bearings 530 may enter bore 412. In the lock position, rod 532 prevents bearings 530 from withdrawing from the partially external position, and thus bearings contact ledge 414 to prevent withdrawal of post 524, thereby locking socket 24 and post 22 together. Likewise, rod 532 can be moved to the release position again to enable separation of socket 24 and plug 22.

Turning now to FIG. 20, an embodiment of a smart device 600 is shown in greater detail. Herein, a sensor 26 is an electronic device which functions for receiving/input or transmitting/output of electronic signals, including receiving or sending electromagnetic signals or wave energy of any type. Sensing units 626 form modules which include one or more sensors 26, or otherwise include an electrical circuit, and which can be separated from a central hub 602. Central hub 602 may itself contain sensors 26 or an electrical circuit. Electrical circuits specifically include electronic processors. It may further be seen that sensing units 626 include electrical connectors 606 which interface with mating connectors 608 on hub 602. In this manner, signals from sensing units can be forwarded through a plug 22/socket 24 associated with hub 602, or may be processed within hub 602 for transmission in another form.

Sensing modules 626 can include a data connector 608 whereby data can be uploaded or downloaded to smart device 600, or data can be sent or received from lamp head 814. Additionally, data can be sent or received using a sensor that is a wireless transmitter and/or receiver. Such data can include electrical signals which can be analyzed to determine a fault with one or more lamp heads, or energy consumption, usage, or other parameter of one or more lamp heads 814.

When sensing modules 626 are interchangeable, for example as shown in FIG. 20, lamp heads can be manufactured with a central hub 602, and sensing modules 626 can be added in the field, or at any point, to correspond to a feature set desired for a particular lamp head 814 and/or location. For example, it may be determined for example that a light sensor is needed every $20^{th}$ lamp head, a wireless transmitter is needed only every $50^{th}$ lamp head or only in certain locations, and cameras are needed on every $10^{th}$ lamp head or post 812. In this manner, a network of lamp heads 814 are created with distributed and targeted functionality, reducing cost, and enabling improved functionality in an interconnected network.

As smart devices are themselves connected to lamp head 814 or post 812 by a socket 24/plug 22, they can be quickly removed and replaced with minimal impact on or from traffic, as described with respect to lamp heads 814. While the embodiment of FIG. 20 is modular in structure and function, it should be understood that smart device 600 can consist of a single unitary device with a single primary function or any number of functions.

FIG. 21 depicts an alternative release structure, which enables the release rod to be offset with respect to a central axis of plug 22. A bar 540 extends across push rod 16 or retaining rod 532, and is affixed at one end relative to plug base 500, and is movable at an opposite end. An offset push rod 16A can be pushed to move bar 540 and thereby push retaining rod 532 to cause the release of plug 22 from socket 24. This structure can be used inside pole 812 or lamp head 814 to be positioned in a convenient location for a user, for example close to access port 822.

In FIG. 22, a socket 24 is mounted within a rigid housing, illustrating one manner of constructing and deploying collar 820. As can be seen in FIG. 22, a bracket 426 is affixed to collar 820, and socket 24 is fastened to bracket 426 via bracket 408. Alternatively, socket 24 can be affixed directly to bracket 426. FIG. 22 additionally depicts a cover 428 which includes a post sized to be inserted into bore 410, and which can include resilient movable tangs (not shown) when engage ledge 414.

In FIG. 23, a cover plate 430A includes one or more sensors 26, which are electrically connected to plug 22 upon which cover plate 430A is mounted. Alternatively, plate 430A could be a surface without sensors 26, and could thereby form a simple cover with a fastening mechanism that is the same as described for plug 22. FIG. 23 additionally depicts how a plug can be configured to include a socket 24A, whereby replaceable devices including either a plug 22 or socket 24 can be mutually interconnected.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. A device for a pole of at least 6 feet in length, the device comprising:

an electrical socket affixed to an end of the pole, the socket including a body having an interior, a cover positioned on the body to cover the interior of the body, the cover having a plurality of ring-shaped openings therethrough providing passage into the interior of the body, a plurality of resiliently mounted electrical contactors each positioned in the interior of the body and adjacent to one of the plurality of ring-shaped openings in the cover;

a central bore extending through the body along an axis about which the plurality of ring-shaped openings of the cover; and a ledge extending radially outwards from the central bore at a side of the body opposite to a side of the body upon which the cover is positioned, wherein the socket is of the type configured to mechanically and electrically connect to a plug having a series of concentric conductive rings positioned to dispose one concentric ring into each ring-shaped opening of the cover when the plug and socket are mated, a post insertable into the central bore of the socket, the post having a central bore and at least one transverse bore through the post that is transverse to the central bore of the post, a spherical bearing positioned within the at least one transverse bore, and a rod having a depressed radial groove formed therein, the rod insertable into the central bore of the post, the rod slideable within the central bore of the post to align the groove with a transverse bore in an unlock position, and to move the groove away from alignment with a transverse bore in an unlocked position.

2. The device of claim 1, the device being a mount to which a street lamp is directly connectable.

3. The device of claim 1, further including a street lamp directly connected to the socket.

4. The device of claim 1, wherein the socket includes a peripheral gear formed about an exterior surface of the body adjacent the cover.

5. The device of claim 4, wherein the socket includes a peripheral gear is mateable with peripheral gear of the plug to maintain a radial orientation of the plug with respect to the socket.

6. The device of claim 1, wherein a fixture is coupled to the plug, the fixture thereby mechanically and electrically connectable to the socket, the fixture thereby mechanically and electrically connectable to the pole.

7. The device of claim 6, wherein the fixture is a lamp head including at least one source of electrically activated illumination.

8. The device of claim 7, wherein the at least one source of electrically activated illumination is LED, fluorescent, incandescent, halogen, HID, metal halide, mercury vapor, or low or high-pressure sodium.

9. The device of claim 6, wherein the fixture is a traffic signal light.

10. The device of claim 6, further including a collar affixed to the fixture sized to conformingly surround the pole to provide support for a mechanical connection of the pole and the fixture when the plug is connected to the socket.

11. The device of claim 10, further including an access port formed in at least one of the collar and the pole to admit passage of a hand or tool proximate the socket and plug to thereby facilitate release of the socket from the plug by movement of the rod.

12. The device of claim 1, wherein the device includes at least one sensor for sensing and signaling a parameter of the environment of the pole when the device is connected to the pole.

13. The device of claim 12, wherein the sensor is a microphone, a speaker, a light sensor, a visible or non-visible light detecting camera, a chemical sensor, a motion sensor, a temperature sensor, a humidity sensor, or a wind sensor.

14. The device of claim 12, further including an electronic processor.

15. The device of claim 12, further including a lamp for producing visible light.

16. The device of claim 12, wherein a lamp is coupled to the plug.

17. The device of claim 16, wherein the lamp further includes a socket of the type connected to the pole.

18. The device of claim 16, wherein the lamp includes one or more sensors, the sensors emitting an electrical signal that is communicated through the plug and socket.

19. The device of claim 1, wherein the pole extends at least 12 feet above a mounting surface, when the pole is mounted upon a mounting surface.

* * * * *